US005867861A

United States Patent [19]

Kasen et al.

[11] Patent Number: 5,867,861

[45] Date of Patent: Feb. 9, 1999

[54] UPRIGHT WATER EXTRACTION CLEANING MACHINE WITH TWO SUCTION NOZZLES

[76] Inventors: Timothy E. Kasen, 7455 Louise Ave., Jenison, Mich. 49428; Stephen J. Simpson, 338 W. 21st St., Holland, Mich. 49423; Luke E. Kelly, 4059 Ponca, SW., Grandville, Mich. 49518; Charles A. Reed, Jr., 3227 Valley View Dr. NE., Rockford, Mich. 49341; Michael R. Blase, deceased, late of Grand Rapids, Mich.; by Gloria R. Blase, legal representative, 2903 Montreat, NE., Grand Rapids, Mich. 49505

[21] Appl. No.: 747,306

[22] Filed: Nov. 12, 1996

[51] Int. Cl.[6] ..... A47L 7/00

[52] U.S. Cl. ..... 15/320; 15/322; 15/416

[58] Field of Search ..... 15/320, 321, 322, 15/416

[56] References Cited

U.S. PATENT DOCUMENTS

| | | | |
|---|---|---|---|
| Re. 35,033 | 9/1995 | Waldhauser . | |
| D. 264,139 | 4/1982 | Pearman, Jr. . | |
| 965,315 | 7/1910 | Moorhead . | |
| 1,476,004 | 12/1923 | Orr . | |
| 1,975,380 | 10/1934 | Streich et al. . | |
| 2,274,560 | 2/1942 | Ott . | |
| 2,292,435 | 8/1942 | Crites . | |
| 2,553,034 | 5/1951 | Bridge . | |
| 2,731,659 | 1/1956 | Coplen . | |
| 2,989,769 | 6/1961 | Houser . | |
| 3,019,462 | 2/1962 | Nash et al. . | |
| 3,060,482 | 10/1962 | Doyle . | |
| 3,206,787 | 9/1965 | Daniels et al. . | |
| 3,599,272 | 8/1971 | Merrick . | |
| 3,747,155 | 7/1973 | Koellisch . | |
| 3,992,747 | 11/1976 | Hufton . | |
| 4,095,309 | 6/1978 | Sundheim | 15/322 X |
| 4,156,952 | 6/1979 | Lynch | 15/322 X |
| 4,164,055 | 8/1979 | Townsend . | |
| 4,270,238 | 6/1981 | Shallenberg et al. . | |
| 4,488,329 | 12/1984 | Lackenbach . | |
| 4,559,667 | 12/1985 | Fitzwater . | |
| 4,817,233 | 4/1989 | Waldhauser . | |
| 4,833,752 | 5/1989 | Merrick . | |
| 4,879,784 | 11/1989 | Shero . | |
| 4,951,346 | 8/1990 | Salmon | 15/416 X |
| 4,956,891 | 9/1990 | Wulff | 15/321 X |
| 5,103,527 | 4/1992 | Holland . | |
| 5,105,503 | 4/1992 | Holland . | |
| 5,168,599 | 12/1992 | Williams . | |
| 5,189,757 | 3/1993 | Williiams et al. | 15/416 X |
| 5,210,902 | 5/1993 | Lee et al. . | |
| 5,280,666 | 1/1994 | Wood et al. . | |
| 5,301,387 | 4/1994 | Thomas et al. . | |
| 5,319,828 | 6/1994 | Waldhauser et al. | 15/322 X |

FOREIGN PATENT DOCUMENTS 2 078 496 6/1981 United Kingdom .

*Primary Examiner*—Charles K. Moore
*Attorney, Agent, or Firm*—Rader, Fishman. Grauer & McGarry

[57] ABSTRACT

A water extraction cleaning machine has a suction nozzle assembly with two suction nozzle openings incorporated. The suction nozzle openings are preferably positioned one on each side of the cleaning solution spray nozzles so that the cleaning machine can be used for simultaneous application and removal of cleaning fluid regardless of whether the user is pushing or pulling the cleaning machine. In another aspect, a plate member is slidably mounted to the bottom of the suction nozzle assembly. The plate member has a pair of suction nozzle openings which are spaced to seal one of the two suction nozzles of the suction nozzle assembly depending upon the direction of travel of the suction nozzle assembly.

17 Claims, 7 Drawing Sheets

UPRIGHT WATER EXTRACTION CLEANING MACHINE WITH TWO SUCTION NOZZLES

This application claims the benefit of U.S. provisional application Ser. No. 60/006,665, filed Nov. 13, 1995.

BACKGROUND OF THE INVENTION

1. Field of the Invention

This invention relates to water extraction cleaning machines and, more particularly, to an upright water extraction cleaning machine having multiple floor suction nozzle openings formed on the suction nozzle assembly.

2. Description of the Related Art

A variety of water extraction cleaning machines are known in the art. For example, a canister-type water extraction cleaning machine is seen in U.S. Pat. No. 5,287,587 to Yonkers et al., an industrial-type water extraction cleaning machine is seen in U.S. Pat. No. 5,383,251 to Whitaker et al., and an upright water extraction cleaning machine is seen in U.S. Pat. No. 5,406,673 to Bradd et al.

The known water extraction cleaning machines tend to be limited to their adaptability for different cleaning operations. One problem with known water extraction cleaning machines is that most machines are not capable of simultaneously spraying cleaning solution and removing the solution from the surface being cleaned regardless of whether the unit is being pushed forwardly or pulled rearwardly.

SUMMARY OF THE INVENTION

The invention overcomes the problems of the prior art by incorporating a suction nozzle assembly into an upright water extraction cleaning machine having two suction nozzle openings, one suction nozzle opening being positioned on each side of the solution distribution means. With this structure, regardless of whether the user is pushing or pulling, the machine is capable of simultaneously applying cleaning solution and then removing the used solution and entrapped dirt.

The invention comprises an upright water extraction cleaning machine having a handle for accommodating forward and rearward motion and a suction nozzle assembly having a front suction nozzle, a rear suction nozzle, and solution distribution spray nozzles positioned intermediate the front and rear a suction nozzles. Preferably, the front and rear suction nozzles are defined by an inner casing which is received inside an outer casing wherein the walls of the casings cooperate to define the two suction nozzles.

In another aspect, the invention comprises a sliding member, preferably a plate, mounted to the bottom surface of the suction nozzle assembly. The sliding plate has a pair of suction nozzle openings formed therein and is slidably mounted to the suction nozzle assembly. The spacing between the suction nozzle openings of the sliding plate are different from spacing of the suction nozzle openings of the suction nozzle assembly. The suction nozzle openings and mounting of plate is designed so that only one of the suction nozzle openings of the plate is aligned with the suction nozzle openings of the nozzle assembly depending upon the direction of movement of the suction nozzle assembly. Preferably, as the suction nozzle assembly is pushed forward, the rear suction nozzle openings of the plate and the suction nozzle assembly are aligned with one another, and the front suction nozzle is effectively closed through interference between the plate and the front suction nozzle opening of the nozzle assembly. In this orientation, substantially all of the working air is drawn in through the rear suction nozzle. Similarly, when the suction nozzle assembly is being pulled rearwardly, the rear suction nozzle is effectively closed while the suction nozzle openings of the front suction nozzle are aligned so that substantially all of the working air is drawn through the front suction nozzle openings.

BRIEF DESCRIPTION OF THE DRAWINGS

The invention will now be described with reference to the drawings in which.

DETAILED DESCRIPTION OF THE PREFERRED EMBODIMENTS

Figure 1:
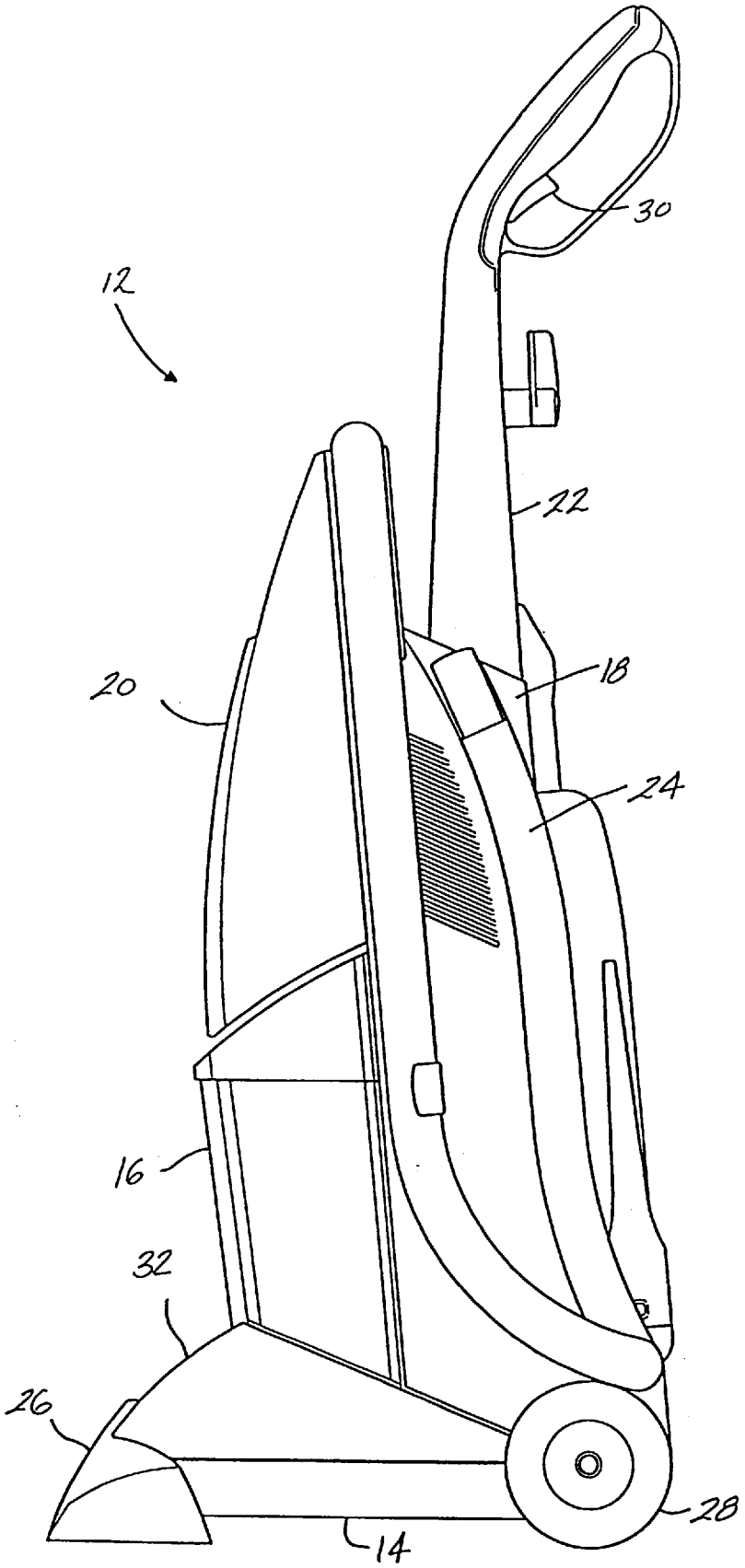
FIG. 1 is a right, side-elevational view of an upright water extraction cleaning machine according to the invention.

An upright water extraction cleaning machine 12 according to the invention is seen in FIG. 1. The machine 12 comprises a base 14, a tank housing 16 selectively mounted on the base 14, an elongated support member 18 pivotally mounted to the base 14, an upper housing 20 securely mounted to the elongated support member 18, an elongated handle 22 extending upwardly from the upper end of the elongated support member 18, and an accessory hose 24 supported on the upper housing 20 and elongated support member.

The base 14 comprises a suction nozzle assembly 26 provided at the front edge of the base 14 and a pair of wheels 28 rotatably supporting the rear of the base. A decorative cover plate 32 extends upwardly and rearwardly from the dual suction nozzle assembly 26 to form a cover for the exposed portion of the base 14.

Although not expressly shown in the drawings or described herein, the water extraction cleaning machine 12 according to the invention incorporates some form of a cleaning solution distribution means adapted to dispense cleaning solution onto the surface being cleaned through actuation of the trigger 30 provided on the upper end of the elongated handle 22. Preferably, a conventional cleaning solution pump (not shown) is fluidly connected to the cleaning solution reservoir of the tank assembly 16 to create a source of pressurized cleaning solution for distribution. The machine 12 also has a vacuum motor (not shown) supported in the upper housing 20 adapted to generate a working air flow which is directed to the suction nozzle assembly 26. Used cleaning solution and dirt are, through the force of the working air, drawn into the machine through the suction nozzle assembly 26. The air is drawn to the tank housing 16 where the dirt and water are separated from the air. The dirt and water remain in the tank housing 16, and the air flows to the vacuum motor and is ultimately exhausted from the machine 12.

The drawings depict an upright water extraction cleaning machine. However, it is to be understood that the suction nozzle assembly could be easily adapted for use on the end of a wand for a conventional canister-type water extraction cleaning machine. In addition, the machine 12 described herein is a clean air system and utilizes a conventional solution pump for creating a source of pressurized cleaning solution. It is to be understood that the suction nozzle assembly according to the invention can be used with any form of cleaning system provided that a source of working air suction and a source of cleaning solution are supplied to the suction nozzle assembly.

Figure 2:
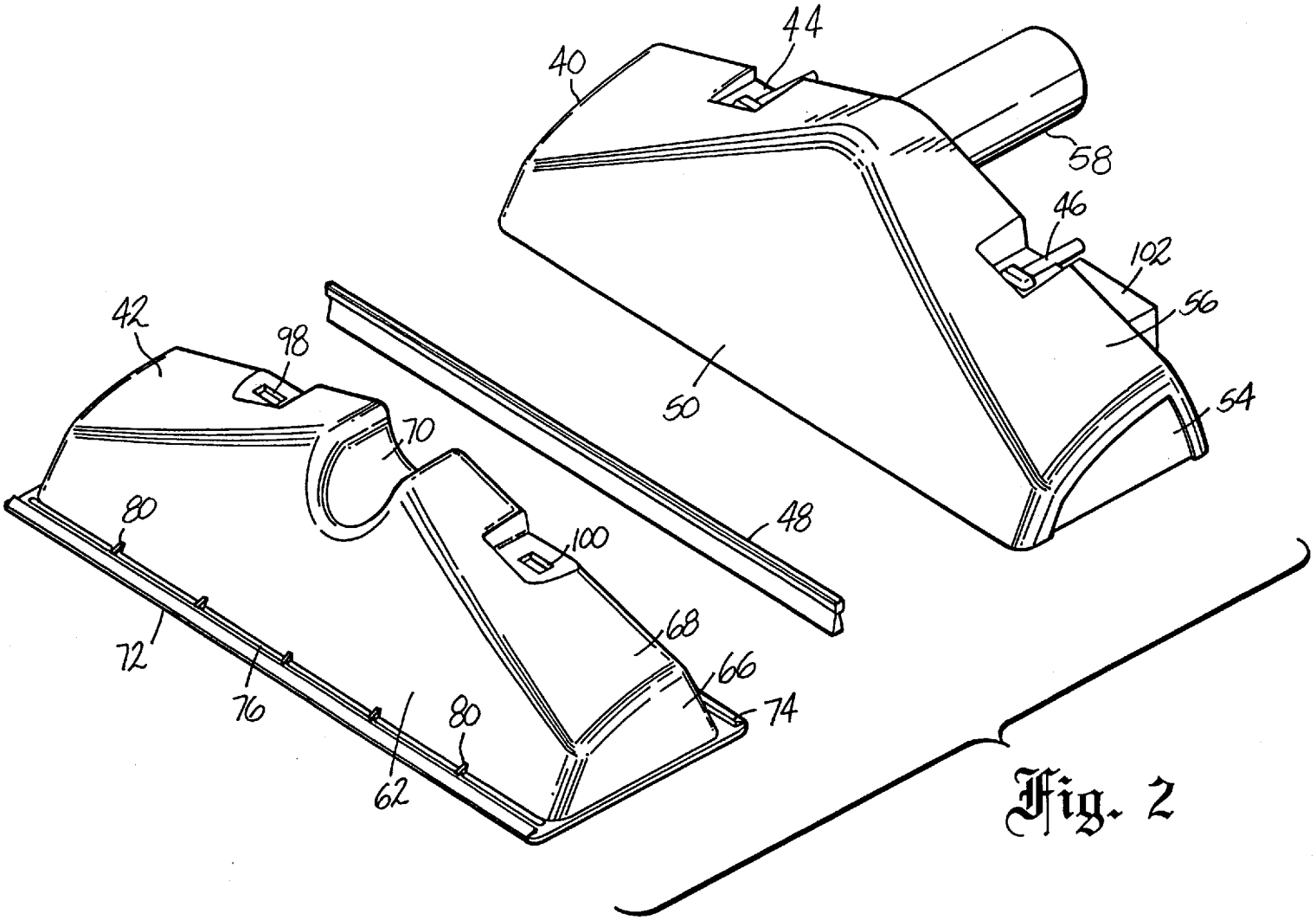
FIG. 2 is an exploded view of a first embodiment of the dual suction nozzle assembly according to the invention.
Figure 3:
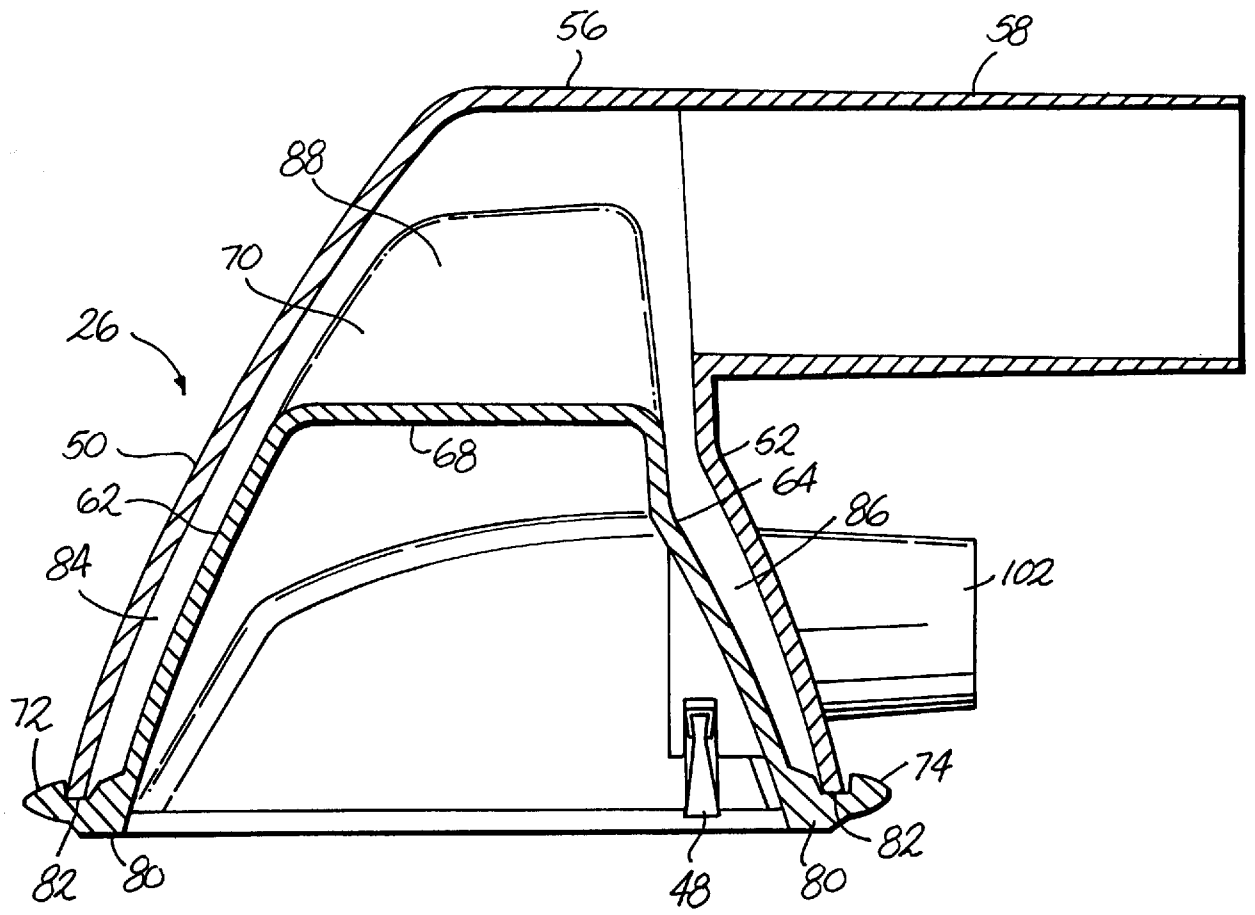
FIG. 3 is a sectional view of the dual suction nozzle assembly of FIG. 2 taken along the centerline of the assembly.
Figure 4:
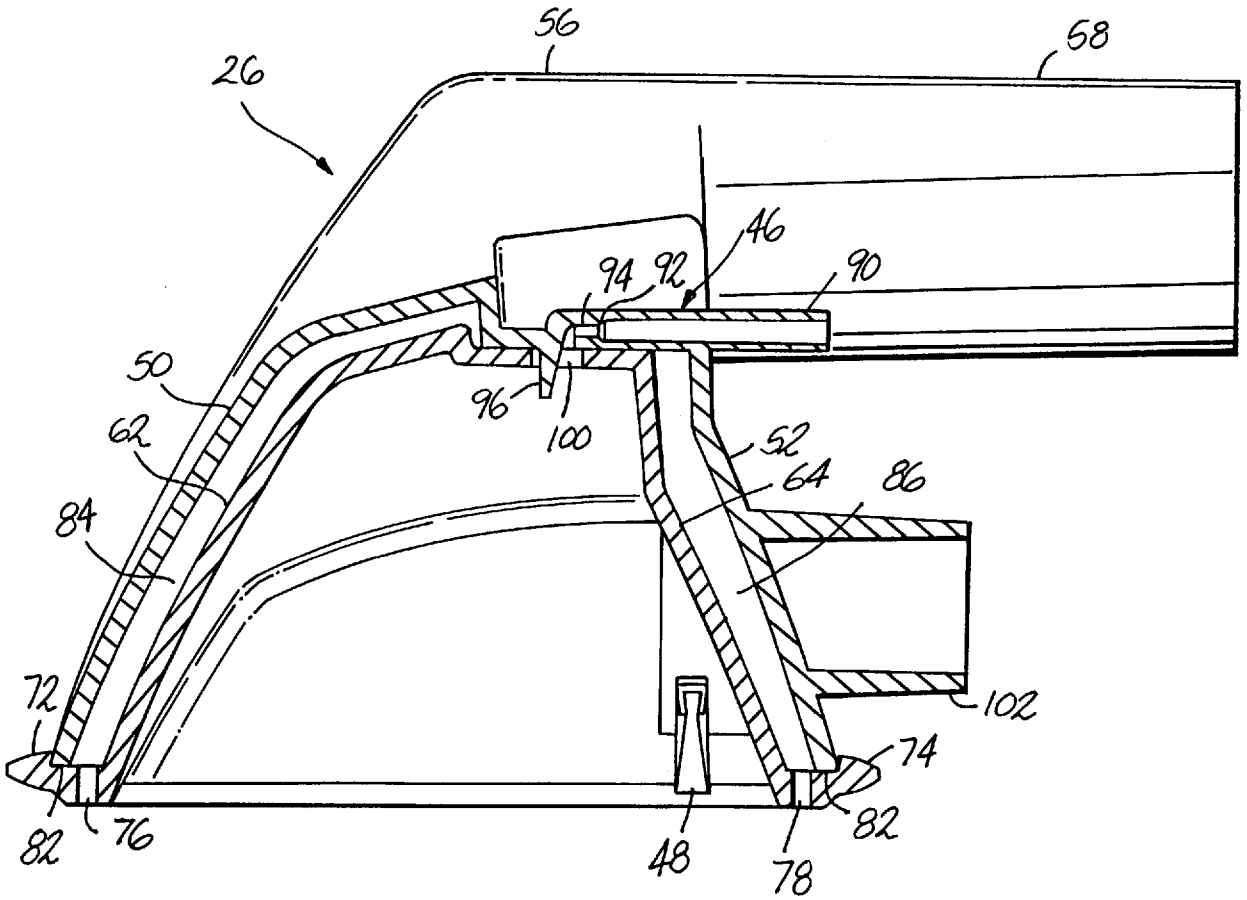
FIG. 4 is a sectional view of the dual suction nozzle assembly of FIG. 2 taken along a line passing through the spray nozzles of the assembly.
Figure 5:
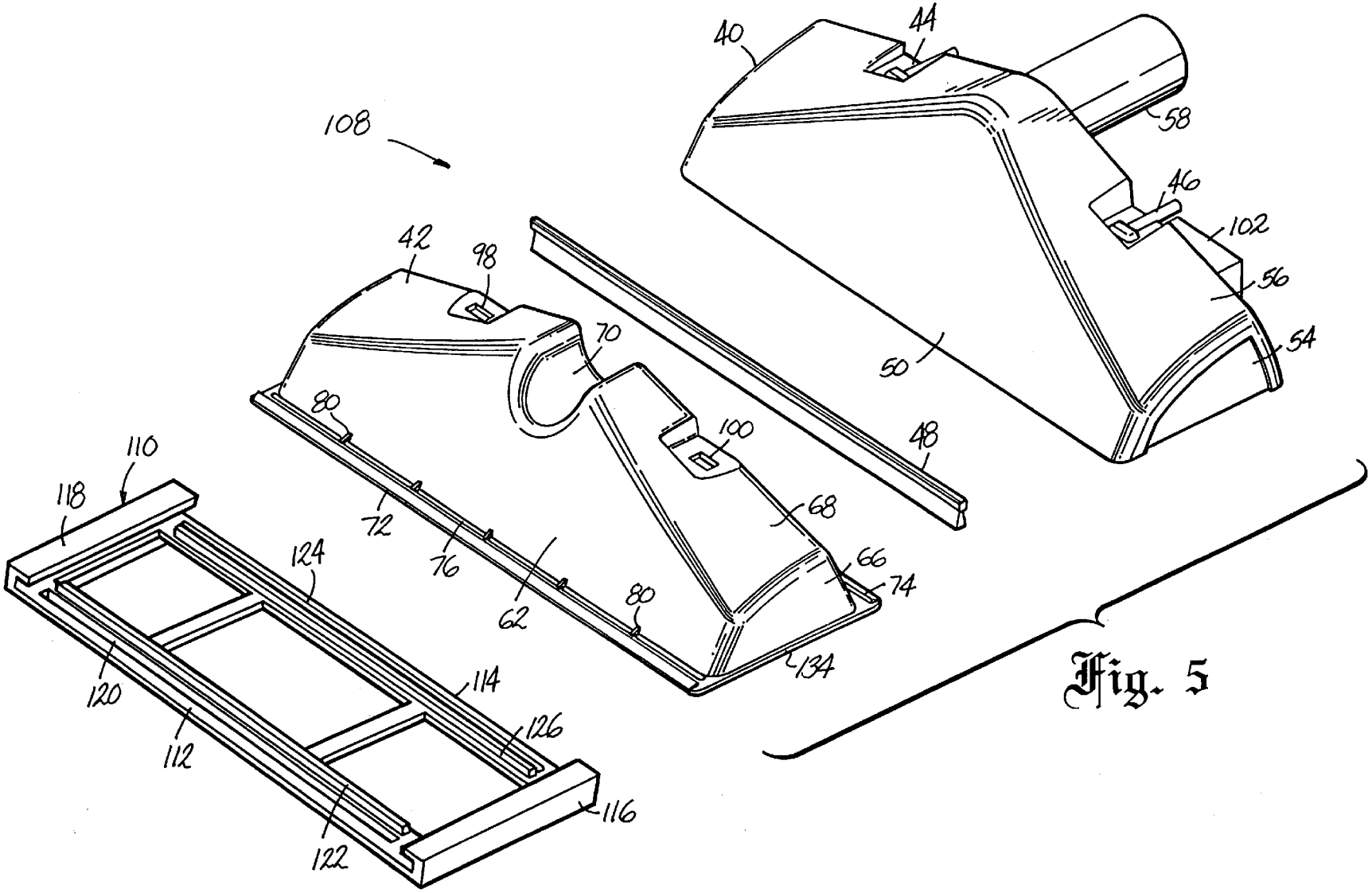
FIG. 5 is an exploded, perspective view of a second embodiment of the dual suction nozzle assembly according to the invention.

As seen in FIGS. 2–4, a first embodiment of the nozzle assembly 26 comprises an outer casing 40, an inner casing 42 received inside the outer casing 40, a pair of spray nozzles 44, 46 extending through the two casings, and a brush 48 securely mounted to the inner casing 42. The outer casing 40 comprises a front wall 50, rear wall 52, a pair of opposed side walls 54, and a top wall 56. A working air outlet conduit 58 is integrally formed into the top to 56 and rear wall 52. The conduit 58 is fluidly connected to the hollow interior defined by the several walls of the outer casing 40.

The inner casing comprises a front wall 62, a rear wall 64, a pair of opposed sidewalls 66, a top wall 68, and a recess 70 formed in the center of the top wall 68. A pair of flanges 72, 74 are formed at the lower edges of the front and rear walls 62, 64, respectively. A suction nozzle opening 76, 78 is formed in each of the front and rear flanges 72, 74, respectively, and a plurality of support ribs 80 are spaced intermittently along the length of each of the nozzle openings 76, 78.

The inner casing 42 is adapted to be received into the hollow interior of the outer casing 40 and fixedly mounted thereto. The bottom edges of the front 50 and rear 52 walls of the outer casing 40 are received in a groove 82 formed in the top surface of the front and rear flanges 72, 74. Once the bottom edges are received in the groove 82, the inner casing 42 is fully received in the outer casing so that the front 62, top 68, and rear 74 walls of the inner casing are spaced from the front 50, top 56, and rear 52 walls of the outer casing, respectively. The casings can be secured to one another by any suitable fastening process such as adhesives, sonic welding, and the like.

With the casings assembled to one another, a front suction nozzle 84 is defined by the front suction nozzle opening 76, front walls 50, 62 of the outer 40 and inner 42 casings, and the sidewalls 54 of the outer casing 40. Similarly, a rear suction nozzle 86 is defined by the rear suction nozzle opening 78, rear walls 52, 64 of the inner 42 and outer 40 casings, and the sidewalls 54 of the outer casing 40. Both the front and rear suction nozzles 84, 86 terminate at the recess 70 formed in the top wall 68 of the inner casing 42. The recess 70, in conjunction with the top wall 56 of the outer casing 40, defines a manifold 88 immediately adjacent one end of the outlet conduit 58.

The spray nozzles 44, 46 are adapted to receive cleaning solution from a suitable source and then distribute the cleaning solution onto the surface to be cleaned intermediate the front and rear suction nozzles 84, 86. The spray nozzles comprise an inlet conduit 90, a compression shoulder 92 formed at the end of the inlet conduit 90, an outlet conduit 94 immediately adjacent the compression shoulder, and a deflector plate 96 positioned a spaced distance from the outlet conduit 94. The deflector plate 96 extends forwardly and downwardly from the outlet conduit 94. A pair of deflector plate apertures 98, 100 are provided in the top wall 68 of the inner casing 42 so that the deflector plates 96 can extend downwardly into the hollow interior defined by the walls of the inner casing 42.

A pair of mounting bosses 102 extend rearwardly from the rear wall 52 of the outer casing 40. The bosses 102 are adapted to be received in complementary recesses (not shown) formed in the base 14 for securing the dual suction nozzle assembly 26 thereto. Preferably, conventional fasteners such as screws are used to secure these two elements to one another. However, a snap-fit interconnection could be integrally formed into these elements in order to eliminate the cost and expense of utilizing fasteners such as screws.

In the solution deposition operation, pressurized cleaning solution is supplied to the spray nozzles 44, 46 from the solution pump as the user squeezes the trigger 30. The solution fills the inlet conduit 90 and contacts the compression shoulder 92, ultimately flowing through the outlet conduit 94. The fluid exiting the outlet conduit 94 strikes the deflector plate 96 and is ultimately deflected downwardly in a fan-shaped pattern onto the surface to be cleaned. Preferably the spray distribution pattern is created to extend substantially the full length of the suction nozzle openings 76, 78. As the machine is pushed or pulled over the surface being cleaned, the brush 48 helps to agitate the surface being cleaned and loosen the dirt while also assisting in deeper penetration of the cleaning solution.

In the preferred embodiment, the spray nozzles 44, 46 are integrally molded into the outer casing 40. However, it is understood that separate spray nozzles or other solution distribution means can be formed separate and mounted to either of the casings.

In the pick-up operation, the vacuum motor is fluidly connected to the outlet conduit 58 so that working air is drawn from both the front and rear suction nozzles 84, 86. As the suction nozzles pass over a surface which has had cleaning solution applied thereto, the cleaning solution and entrained dirt are drawn into the suction nozzle openings 76, 78 up to the recess 70 and ultimately out of the nozzle assembly 26 through the outlet conduit 58 to the tank housing. One unique advantage of the nozzle assembly 26 according to the invention is the coordination of the spray nozzles 44, 46 and the suction nozzles 84, 86. As the user pushes the cleaning machine 12 forward and squeezes the trigger 30, loose dirt particles will be drawn into the front suction nozzle 76 for collection, cleaning solution will be sprayed onto the surface being cleaned, and then the used cleaning solution and entrained dirt will be drawn into the rear suction nozzle 78. Conversely, as the user pulls the cleaning machine 12 rearward and squeezes the trigger 30, loose dirt particles will be drawn into the rear suction nozzle 78 for collection, cleaning solution will be sprayed onto the surface being cleaned, and then the used cleaning solution and entrained dirt will be drawn into the front suction nozzle 76. Therefore, regardless of whether the user is pushing or pulling the upright water extraction cleaning machine, the nozzle will "pre-clean" the surface by removing loose dirt particles and simultaneously removing the used cleaning solution and entrained dirt.

A second embodiment of the dual suction nozzle assembly is seen in FIGS. 5–9. In this embodiment, the same reference numerals for identical elements seen in the first embodiment will be carried forth into the description of the second embodiment.

Similar to the first embodiment, the second embodiment of the dual suction nozzle assembly comprises an inner casing 42 selectively mounted in the hollow interior of the outer casing 40. In addition, a plate member 110 is slidably mounted to the bottom side edges of the inner casing 42. The plate member 110 comprises a front flange 112, a rear flange 114, a pair of side flanges 116, 118 interconnecting the front and rear flanges 112, 114 and at least one rib also interconnecting the front and rear flanges 112, 114. The front flange has a suction nozzle opening 120 extending substantially the entire length thereof and an upwardly extending stop 122 provided on the top surface of the flange 112, immediately rearwardly from the suction nozzle opening 120. Similarly, the rear flange 114 has a suction nozzle opening 124 extending substantially the entire length thereof and an upwardly extending stop 126 provided on the top surface of the flange 114, immediately rearwardly from the suction nozzle opening 124. The side flanges 116, 118 each comprise an inwardly facing U-shaped channel formed from a bottom wall 128, a top wall 130 opposite the bottom wall 128 and a bight wall 132 extending between the outside edges of the top and bottom walls 128, 130.

As seen in FIGS. 6–9, the plate member 110 is slidably mounted to the bottom edges of the inner casing 42 of the suction nozzle assembly. The U-shaped channels of the plate member 110 slidably receive outwardly extending side flanges 134 of the inner casing 42. The side flanges 134 act as guides to control the sliding movement of the plate 110 with respect to the suction nozzle assembly 108. The sliding movement of the plate member 110 with respect to the suction nozzle assembly 108 is also limited by the front and rear stops 122, 126. The stops 122, 126 are both positioned inwardly of the front wall 62 and rear wall 64 of the inner casing. When the plate member 110 is properly positioned on the suction nozzle assembly 108, the stops are positioned to selectively contact the bottom edges of the front and rear walls 62, 64 of the inner casing 42. The interaction between the stops 122, 126 and the front and rear walls 62, 64 of the inner casing 42 limits the forward and rearward travel of the plate member 110 with respect to the suction nozzle assembly 108.

Figure 6:
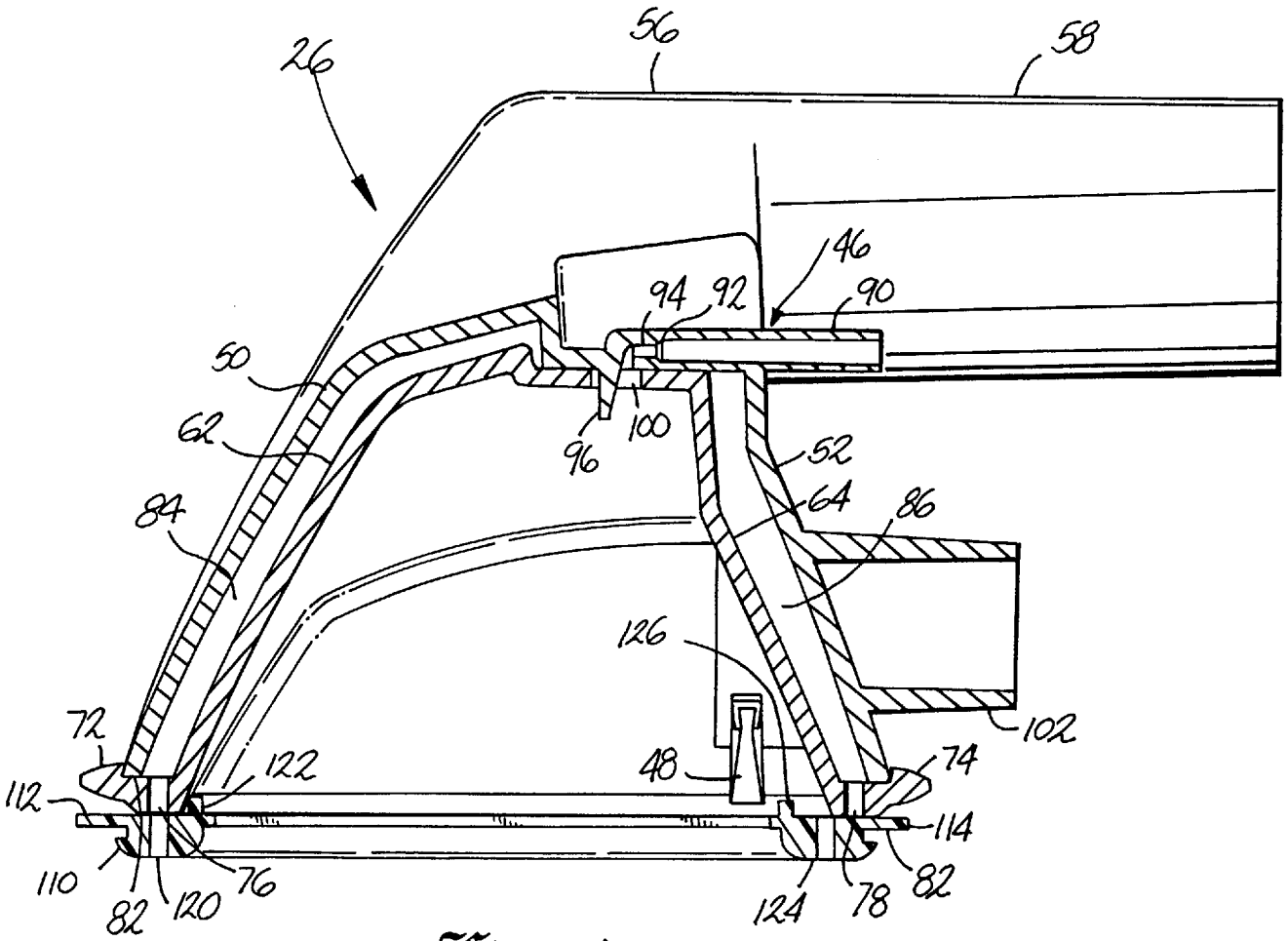
FIG. 6 is a sectional view of the dual suction nozzle assembly of FIG. 5, similar to the view seen in FIG. 4.
Figure 7:
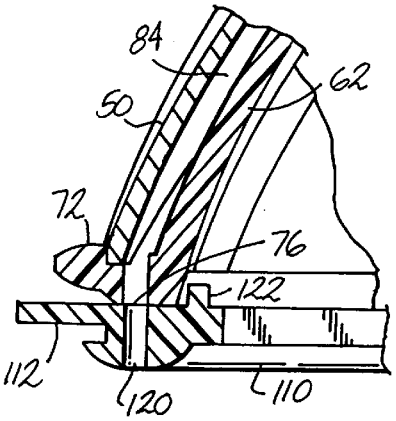
FIG. 7 is a detail, sectional view of the front suction nozzle opening as seen in FIG. 6.
Figure 9:
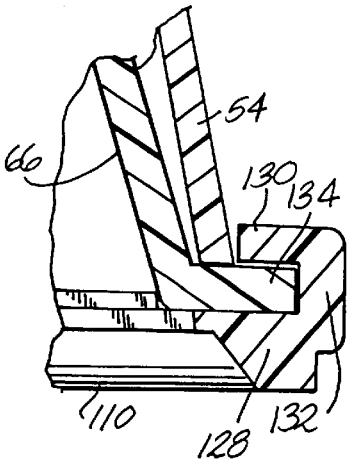
FIG. 9 is a partial, sectional view of the sidewall of the second embodiment of the dual suction nozzle assembly seen in FIG. 5.
Figure 8:
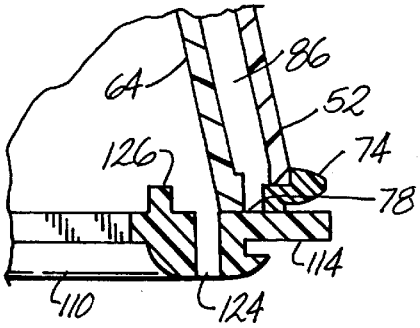
FIG. 8 is a detail, sectional view of the rear suction nozzle opening of FIG. 6.

The plate member 110 is structured to restrict the working airflow to only one of the front and rear suction nozzles 84, 86 depending upon the direction of travel of the suction nozzle assembly 108. The spacing between the two suction nozzle openings 120, 124 of the plate member 110 differs slightly, preferably slightly less than, the spacing between the two suction nozzle openings 76, 78 of the suction nozzle assembly 108. The spacing of the suction nozzle openings 120, 124 and positioning of the stops 122, 126 is designed so that as the user pulls the suction nozzle assembly 108 rearwardly as seen in FIG. 6, the front suction nozzle opening 120 of the plate member 110 is aligned with the front suction nozzle opening 76 of the suction nozzle assembly 108. However, in this position, the rear suction nozzle opening 78 of the suction nozzle assembly 108 is not aligned with the suction nozzle opening 124 of the plate member 110. Preferably, the rear flange 114 covers the rear suction nozzle opening 78 of the suction nozzle assembly 108 in this position and substantially prevents the flow of air therethrough. Therefore, all of the working air is directed solely to the front suction nozzle 84. The front stop 122 contacts the bottom edge of the front wall 62 and limits the movement of the plate member 110 with respect to the inner casing 42. As the user applies cleaning solution through the spray nozzles 44, 46 and pulls rearwardly, the solution is applied onto the surface being cleaned and picked up shortly thereafter as the front suction nozzle passes over the surface.

When the user shifts the direction of operation of the machine and begins to push the suction nozzle assembly forward, the plate member 110 slides rearwardly with respect to the inner casing 42 a short distance until the rear stop 126 contacts the bottom edge of the rear wall 64 of the inner casing 42. In this position, the rear suction nozzle opening 124 of the plate member 110 is aligned with the opening of the rear suction nozzle 86. Similarly, the opening of the front suction nozzle 84 is effectively sealed by the front flange 112. Therefore all of the working air is directed solely to the rear suction nozzle 86. As the user applies cleaning solution through the spray nozzles 44, 46 and pushes forwardly, the solution is applied onto the surface being cleaned and picked up shortly thereafter as the rear suction nozzle 86 passes over the surface.

While the second embodiment of the suction nozzle assembly does not have the benefit of two active suction nozzle openings as in the first embodiment, the second embodiment does have the advantage of focusing all of the lifting force of the working air created by the vacuum motor on removal of the used cleaning solution. Both embodiments allow for effective water extraction cleaning during pushing and pulling of the suction nozzle assembly.

Reasonable variation and modification are possible within the spirit of the foregoing specification and drawings without departing from the scope of the invention.

The embodiments for which an exclusive property or privilege is claimed are defined as follows:

1. An upright water extraction cleaning machine comprising:

a base module adapted to be moved across a surface being cleaned;

a handle pivotally mounted to the base;

a cleaning fluid tank adapted to receive a cleaning fluid, the cleaning fluid tank being mounted on one of the base module and handle;

a recovery tank adapted to receive collected, used cleaning fluid, the recovery tank being mounted on one of the base module and handle;

a vacuum motor adapted to create a working air flow, the motor being mounted on one of the base module and handle and being fluidly connected to the recovery tank;

a suction nozzle member fluidly connected to the vacuum motor and having a first suction nozzle opening adapted to contact a surface being cleaned, a second suction nozzle opening adapted to contact a surface being cleaned, the first and second suction nozzle openings being substantially parallel to and spaced from one another;

a spray nozzle fluidly connected to the cleaning fluid tank, mounted to the base module, and adapted to distribute cleaning fluid onto the surface being cleaned intermediate the first and second suction nozzle openings;

the suction nozzle member comprising an outer casing having front and rear walls and an inner casing having front and rear walls, the outer and inner casings mounted to one another so that the front and rear walls of the casings define at least a portion of a fluid flow conduit extending between the suction nozzle openings and the recovery tank; and at least one of the front and second suction nozzle openings being formed in a flange provided on the inner casing.

2. An upright water extraction cleaning machine according to claim 1 wherein the rear suction nozzle opening is formed in a flange provided on the inner casing.

3. An upright water extraction cleaning machine according to claim 1 and further comprising a brush mounted to the base module so that the brush is positioned intermediate the first and second suction nozzle openings.

4. An upright water extraction cleaning machine according to claim 1 wherein the suction nozzle includes a plate member mounted to the bottom of the suction nozzle member for limited articulation therewith, the plate member having first and second suction nozzle openings, the first suction nozzle opening of the plate being aligned with the first suction nozzle opening of the suction nozzle member and the second suction nozzle opening of the suction nozzle member being effectively sealed when the water extraction cleaning machine is moved in a first direction.

5. An upright water extraction cleaning machine according to claim 4 wherein the plate member is slidably mounted to the bottom surface of the suction nozzle member so that the second suction nozzle opening of the plate is aligned with the second suction nozzle opening of the suction nozzle member and the first suction nozzle opening of the suction nozzle member is effectively sealed when the water extraction cleaning machine is moved in a second direction.

6. An upright water extraction cleaning machine according to claim 5 wherein the first direction is opposite the second direction.

7. An upright water extraction cleaning machine according to claim 4 wherein the plate member has a pair of opposed side edges and further comprises a pair of U-shaped flanges formed on the side edges, the U-shaped flanges being adapted to slidably receive at least a portion of the suction nozzle member.

8. An upright water extraction cleaning machine according to claim 7 and further comprising at least one stop formed on one of the plate member and the suction nozzle member, the at least one stop being adapted to limit the articulation of these two elements with respect to one another.

9. An upright water extraction cleaning machine according to claim 4 and further comprising at least one stop formed on one of the plate member and the suction nozzle member, the at least one stop being adapted to limit the articulation of these two elements with respect to one another.

10. An upright water extraction cleaning machine comprising:

a base module adapted to be moved across a surface being cleaned;

a handle pivotally mounted to the base;

a cleaning fluid tank adapted to receive a cleaning fluid, the cleaning fluid tank being mounted on one of the base module and handle;

a recovery tank adapted to receive collected, used cleaning fluid, the recovery tank being mounted on one of the base module and handle;

a vacuum motor adapted to create a working air flow, the motor being mounted on one of the base module and handle and being fluidly connected to the recovery tank;

a suction nozzle assembly fluidly connected to the vacuum motor and comprising an inner casing having front and rear walls, an outer casing having front and rear walls, a first suction nozzle defined, in part; by the front walls of the inner and outer casings, a first suction nozzle opening fluidly connected to the first suction nozzle and, adapted to contact a surface being cleaned, a second suction nozzle defined, in part, by the rear walls of the inner and outer casings, and a second suction nozzle opening fluidly connected to the second suction nozzle and adapted to contact a surface being cleaned, the first and second suction nozzle openings being spaced from one another; and a spray nozzle fluidly connected to the cleaning fluid tank, mounted to the base module, and adapted to distribute cleaning fluid onto the surface being cleaned intermediate the first and second suction nozzle openings.

11. An upright water extraction cleaning machine according to claim 10 and further comprising a brush mounted to the base module so that the brush is positioned intermediate the first and second suction nozzle openings.

12. A water extraction cleaning machine comprising:

a cleaning fluid tank adapted to store cleaning fluid;

a recovery tank adapted to receive collected, used cleaning fluid;

a vacuum motor adapted to create a working air flow, the motor being fluidly connected to the recovery tank;

a suction nozzle member fluidly connected to the vacuum motor and having a first suction nozzle opening adjacent a surface being cleaned and a second suction nozzle opening adapted to contact a surface being cleaned;

a plate member mounted to the bottom of the suction nozzle member for limited articulation therewith, the plate member having first and second suction nozzle openings in a first position as the suction nozzle member is moved in a first direction, the first suction nozzle opening of the plate being aligned with the first suction nozzle opening of the suction nozzle member and the second suction nozzle opening of the suction nozzle member being effectively sealed; and a spray nozzle fluidly connected to the cleaning fluid tank, mounted to the base module, and adapted to distribute cleaning fluid onto the surface being cleaned intermediate the first and second suction nozzle openings.

13. A water extraction cleaning machine according to claim 12 wherein the plate member is slidably mounted to the bottom surface of the suction nozzle member so that in a second position, as the suction nozzle member is moved in a second direction, the second suction nozzle opening of the plate is aligned with the second suction nozzle opening of the suction nozzle member and the first suction nozzle opening of the suction nozzle member is effectively sealed.

14. A water extraction cleaning machine according to claim 13 wherein the first direction is opposite the second direction.

15. A water extraction cleaning machine according to claim 13 wherein the plate member has a pair of opposed side edges and further comprises a pair of U-shaped flanges formed on the side edges, the U-shaped flanges being adapted to slidably receive at least a portion of the suction nozzle member.

16. An upright water extraction cleaning machine according to claim 15 and further comprising at least one stop formed on one of the plate member and the suction nozzle member, the at least one stop being adapted to limit the articulation of these two elements with respect to one another.

17. An upright water extraction cleaning machine according to claim, 12 and further comprising at least one stop formed on one of the plate member and the suction nozzle member, the at least one stop being adapted to limit the articulation of these two elements with respect to one another.

* * * * *